United States Patent [19]

Ampferer et al.

[11] Patent Number: 4,883,031

[45] Date of Patent: Nov. 28, 1989

[54] INTERNAL COMBUSTION ENGINE

[75] Inventors: Herbert Ampferer, Sachsenheim; Klaus Groeger, Hemmingen, both of Fed. Rep. of Germany

[73] Assignee: Dr. Ing. h.c.F. Porsche AG, Weissach, Fed. Rep. of Germany

[21] Appl. No.: 230,019

[22] Filed: Aug. 9, 1988

[30] Foreign Application Priority Data

Aug. 25, 1987 [DE] Fed. Rep. of Germany ..... 3728268

[51] Int. Cl.[4] ..... F02B 77/00

[52] U.S. Cl. ..... 123/195 C; 123/198 E

[58] Field of Search ..... 123/195 C, 198 E

[56] References Cited

U.S. PATENT DOCUMENTS

| | | | |
|---|---|---|---|
| 2,303,093 | 11/1942 | Schreck | 123/195 A |
| 3,726,365 | 4/1973 | Russell | 123/198 E |
| 4,203,407 | 5/1980 | Fachbach et al. | 123/198 E |
| 4,257,370 | 3/1981 | Kasting | 123/195 C |
| 4,480,609 | 11/1984 | Hayashi | 123/198 E |
| 4,508,072 | 4/1985 | Takami et al. | 123/198 E |
| 4,553,473 | 11/1985 | Ichida et al. | 123/193 H |
| 4,559,910 | 12/1985 | Tsuchiyama et al. | 123/198 E |

FOREIGN PATENT DOCUMENTS

| | | | |
|---|---|---|---|
| 0124433 | 11/1984 | European Pat. Off. | 123/195 C |
| 0048494 | 1/1985 | European Pat. Off. . | |
| 1576345 | 2/1970 | Fed. Rep. of Germany . | |
| 7631631 | 1/1977 | Fed. Rep. of Germany . | |
| 18655 | 12/1913 | France . | |
| 0255249 | 11/1986 | Japan | 123/195 C |

*Primary Examiner*—David A. Okonsky

*Attorney, Agent, or Firm*—Barnes & Thornburg

[57] ABSTRACT

An internal combustion engine includes a crankcase with a crankshaft which drives at one end face of the crankcase, auxiliary aggregates—oil pump—and endless elements. The oil pump and the endless elements are covered off by means of a covering which consists of a sheet metal part including two thin-walled layers and is constructed pot-shaped in cross section. This lightweight covering which is simple in construction is secured at the end wall of the crankcase by means of an edge flange and by means of bolts.

25 Claims, 3 Drawing Sheets

INTERNAL COMBUSTION ENGINE

BACKGROUND AND SUMMARY OF THE INVENTION

The present invention relates to an internal combustion engine with preferably V-shaped cylinder rows and a crankshaft supported in a crankcase which is constructed adjacent an end-face of the crankcase for the drive of auxiliary aggregates and/or endless elements, whereby the auxiliary aggregates and/or endless elements are covered at least partially by a detachable covering extending over a partial area of the end face.

In a known internal combustion engine described in French Patent 18.655 (addition to French Patent 457,474), an oil pump is arranged at the end-face of a crankcase whose housing is completely non-covered so that the noises of the oil pump appear essentially unobstructedly.

It is the object of the present invention to provide an internal combustion engine whose crankcase and crankshaft are so constructed at an end face that auxiliary aggregates and/or endless elements of the internal combustion engine are covered off in a cost-favorable and weight-saving manner to provide a low-noise arrangement with functionally correct drive.

The underlying problems are solved according to the present invention in that the covering is a sheet metal part having at least two relatively thin-walled layers, has a pot-shaped cross section and is secured at the end face of the crankcase by means of a circumferential edge flange and by means of bolts, and in that the covering is further supported with a section of a base wall at a housing of the auxiliary aggregate formed by the oil pump.

The principal advantages achieved with the present invention reside in that the covering provides a low-noise cover for the auxiliary aggregates and endless elements at the end face of the crankcase. The covering formed by two relatively thin-walled sheet metal layers can thereby be manufactured in a simple and light-weight manner. Additionally, it absorbs without any problems the thermal expansions of the, for example, light-metal crankcase.

Owing to the extension connected with the crankcase, not only a short type of construction is possible with the mentioned crankshaft, but the drive of the auxiliary aggregates and endless elements can be realized in an effective manner. Additionally, the extension contributes to assembly simplification of the auxiliary aggregates and/or endless elements.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 2:
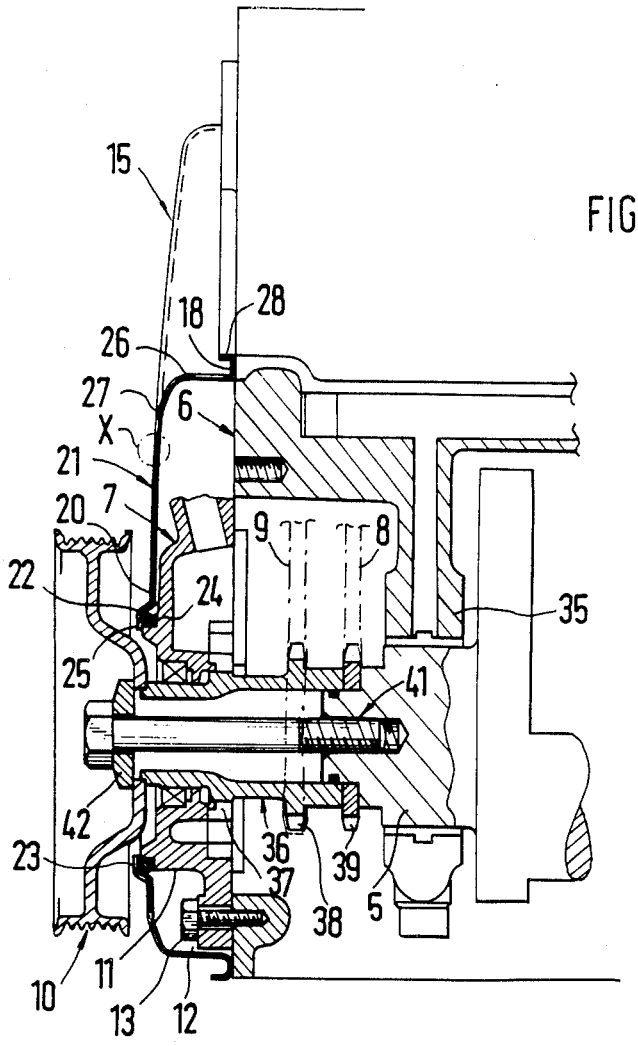
FIG. 2 is a cross-sectional view, taken along line II—II of FIG. 1.

Referring now to the drawing wherein like reference numerals are used throughout the various views to designate like parts, an internal combustion engine 1 includes a crankcase 2 which has two formed-on cylinder rows 3 and 4—V-type construction—and is constructed for mounting a crankshaft 5. Adjacent an end face 6 (FIG. 2) of the crankcase the crankshaft 5 is constructed for the drive of auxiliary aggregates, such as oil pump 7 and alternator, as well as endless elements 8 and 9. A driving gear 10 connected with the crankshaft 5 cooperates with the alternator (not shown); the endless elements 8 and 9 cooperate with cam shafts (not shown) arranged above the cylinders.

The oil pump 7 protrudes with a housing 11 beyond the end face 6 of the crankcase 2 and is secured at the crankcase 2 at 12 by means of bolts 13.

Figure 1:
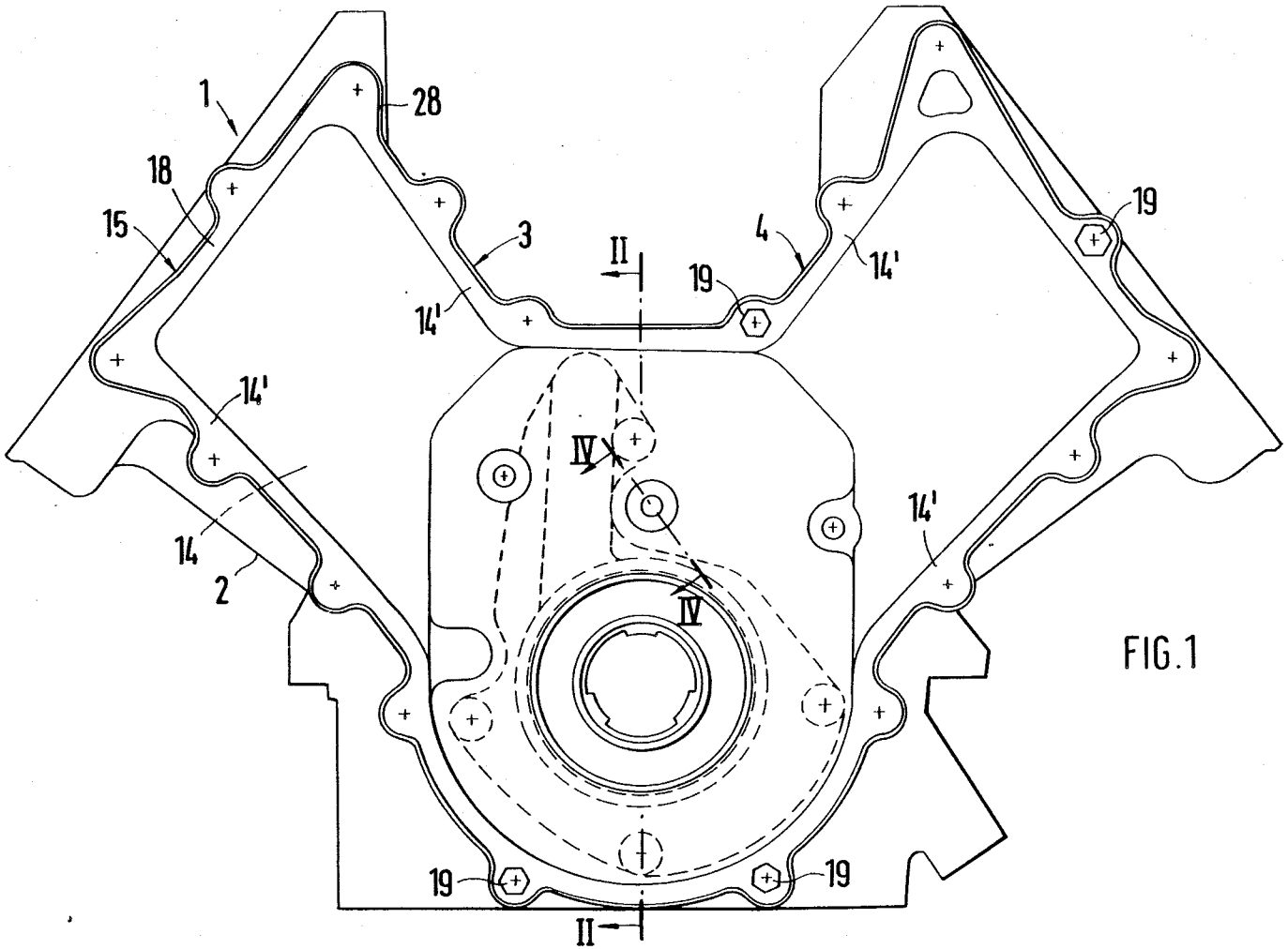
FIG. 1 is an end elevational view on an end face of an internal combustion engine in accordance with the present invention.

For the installation of the endless elements 8 and 9 and their tensioning and/or slide devices, the crankcase 2 is provided at the end face 6 with an opening 14 which is delimited by a wall 14' (FIG. 1).

Figure 3:
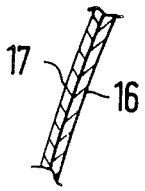
FIG. 3 is a detail X of FIG. 2, on an enlarged scale.

The endless elements 8 and 9 and the oil pump 7 are covered off by a covering 15 which consists of sheet metal and, more particularly, of two thin-walled contacting layers 16 and 17 (FIG. 3). The thickness of the layers 16 and 17 amounts to about 0.5 mm. In cross section, the covering 15 is constructed pot-shaped (FIG. 2) whereby it is secured at the end face by way of an edge flange 18 that extends along the wall 14' of the crankcase 2, and by several bolts 19. Within the area of the oil pump 7, the covering 15 is supported at the outside of the housing 11 by means of a section 20 of a base wall 21 and by means of a sealing member 22. For mounting the sealing member 22, the section 20 includes a pressed-out portion 23 leading away from the base wall 21 and the housing 11 is provided with a recess 24. The base wall 21 is also provided with an opening 25 inside of the pressed-out portion 23. The covering 15 includes an edge-like wall 26 between the edge flange 18 and the base wall 21 which extends at right angle to the edge flange 18. For reinforcing the covering 15, the base wall 21 is convexly curved at least locally (see at 27). The angularly bent portion 28 at the free end of the edge flange 18 serves the same purpose.

Figure 4:
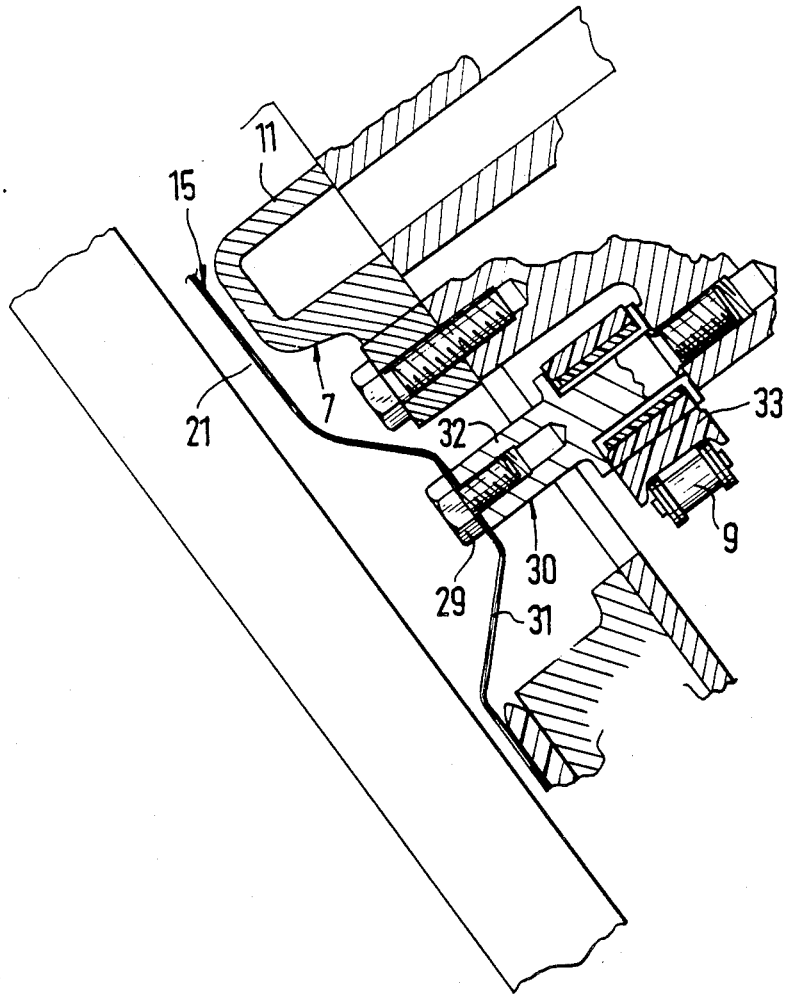
FIG. 4 is a cross-sectional view taken along line IV—IV of FIG. 1, on an enlarged scale.

According to FIG. 4, the base wall 21 is additionally secured at a fixed part 30 of the crankcase 2 by means of a bolt 29. The base wall 21 includes thereat an indentation 31. The fixed part 30 is a fastening pin 32 for a tensioning and/or slide rail 33 of the endless member 9.

The crankshaft 5 terminates for weight reasons within the area of a bearing block or cradle 35 (FIG. 2) of the crankcase 2 whereby the bearing block or cradle 35 extends with a parallel spacing to the end face 6. A bushing-like axial extension 36 of the crankshaft 5 serves for the drive of the oil pump 7, also of the endless elements 8 and 9. The extension 36 which is a separate component, cooperates with the oil pump 7 at 37 and is provided with a driving gear 38 for the endless element 9. A further driving gear 39 for the endless element 8 is illustrated in the embodiment as separate component, non-rotatably connected with the crankshaft 5. However, the same can also be made in one piece with the extension 36.

The extension 36 and the crankshaft 5 are connected by means of a bolt 40 which is effective in the axial direction of the crankshaft 5, that is, it is screwed into an axial threaded bore 41 of this shaft. The bolt 40 clamps the extension 36 against the crankshaft 5 by means of a disk 42 and the drive gear 10 (for the alternator).

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claim.

We claim:

1. An internal combustion engine comprising cylinder means and a crankshaft rotatably supported in a crankcase which adjacent an end face of the crankcase is constructed for the drive of at least one of auxiliary aggregates and endless elements housed in an accessory housing secured at the end face of the crankcase, cover means at least partly covering the at least one of auxiliary aggregates and endless members, said cover means extending at least over a partial area of the end face of the crankcase and being detachable, the cover means being a sheet metal part including at least two relatively thin-walled layers which contact one another and having a pot-shaped cross section, said cover means being secured at the end face of the crankcase by means of a circumferential edge flange and by means of bolts, and the cover means being supported with a section of a convexly curved base wall of the cover means at the housing by a sealing member.

2. An internal combustion engine according to claim 1, wherein the auxiliary aggregate is an oil pump.

3. An internal combustion engine according to claim 2, wherein the cylinder means are V-shaped cylinder rows.

4. An internal combustion engine according to claim 1, wherein the cover means includes an edge-like wall extending approximately perpendicularly to the edge flange.

5. An internal combustion engine according to claim 1, wherein the free end of the edge flange is provided with an angularly bent portion.

6. An internal combustion engine according to claim 1, wherein for purposes of mounting the sealing member, said section includes a pressed-out portion leading away from the base wall and the housing of the oil pump includes a recess.

7. An internal combustion engine according to claim 1, wherein the base wall is locally secured at a fixed part of the crankcase by means of a bolt.

8. An internal combustion engine according to claim 7 wherein the fixed part is a fastening pin for a tensioning or slide rail of an endless element.

9. An internal combustion engine according to claim 2, wherein a bushing-like axial extension of the crankshaft serves for the drive of the oil pump.

10. An internal combustion engine according to claim 9, wherein the extension carries at least one drive gear for an endless element.

11. An internal combustion engine according to claim 9, wherein the extension and the crankshaft are connected by means of a bolt which is effective in the axial direction of the crankshaft.

12. An internal combustion engine according to claim 11 wherein a drive gear is fixed between the last-mentioned bolt and the extension.

13. An internal combustion engine according to claim 4, wherein the free end of the edge flange is provided with an angularly bent portion.

14. An internal combustion engine according to claim 13, wherein for purposes of mounting the sealing member, said section includes a pressed-out portion leading away from the base wall and the housing is for a oil pump and includes a recess.

15. An internal combustion engine according to claim 14 wherein the base wall is locally secured at a fixed part of the crankcase by means of a bolt.

16. An internal combustion engine according to claim 15, wherein the fixed part is a fastening pin for a tensioning or slide rail of an endless element.

17. An internal combustion engine according to claim 16, wherein a bushing-like axial extension of the crankshaft serves for the drive of the oil pump.

18. An internal combustion engine according to claim 17 the extension carries at least one drive gear for an endless element.

19. An internal combustion engine according to claim 18, wherein the extension and the crankshaft are connected by means of a bolt which is effective in the axial direction of the crankshaft.

20. An internal combustion engine according to claim 19, wherein a drive gear is fixed between the last-mentioned bolt and the extension.

21. An internal combustion engine comprising:

cylinder means;

crankshaft rotatably supported in a crankcase having an end face, the crankshaft driving at least one of auxiliary aggregates and endless elements;

an accessory housing secured at the end face of the crankcase for housing the at least one of auxiliary aggregates and endless elements;

cover means for reducing noise from the at least one of auxiliary aggregates and endless elements, the cover means projecting over the accessory housing from a circumferential end flange of the cover means at the end face of the crankcase and extending to and supported substantially at the housing by a sealing member; and bolt means for detachably securing the cover by the circumferential end flange to the end face of the crankcase.

22. An internal combustion engine according to claim 21, wherein the cover means has a pot-shaped cross-section.

23. An internal combustion engine according to claim 22, wherein the cover means has a convexly curved base wall, a section of the base wall engaging the sealing member at the housing.

24. An internal combustion engine according to claim 21, wherein the cover means is supported solely at the housing by the sealing member.

25. An internal combustion engine according to claim 21, wherein the cover means to supported centrally at the housing by the sealing member.

* * * * *